US009711303B2

(12) United States Patent
Chen

(10) Patent No.: US 9,711,303 B2
(45) Date of Patent: Jul. 18, 2017

(54) DOME-SHAPED ASSEMBLY AND HANDHELD ELECTRONIC DEVICE INCLUDING DOME-SHAPED ASSEMBLY

(71) Applicant: BlackBerry Limited, Waterloo (CA)

(72) Inventor: Chao Chen, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 66 days.

(21) Appl. No.: 13/928,988

(22) Filed: Jun. 27, 2013

(65) Prior Publication Data

US 2015/0001058 A1 Jan. 1, 2015

(51) Int. Cl.
*H01H 5/18* (2006.01)
*H01H 13/85* (2006.01)

(52) U.S. Cl.
CPC ..... *H01H 13/85* (2013.01); *H01H 2209/01* (2013.01); *H01H 2215/024* (2013.01)

(58) Field of Classification Search
CPC .. H01H 1/00; H01H 5/04; H01H 5/18; H01H 2003/00; H01H 1/06; H01H 3/00; H01H 3/12; H01H 5/00; H01H 13/00; H01H 13/02; H01H 13/14; H01H 13/26; H01H 13/285; H01H 13/28; H01H 13/50; H01H 13/52; H01H 13/64; H01H 13/66; H01H 13/705; H01H 2003/12; H01H 2215/00; H01H 2215/002; H01H 2215/004; H01H 2215/006; H01H 2215/014; H01H 2215/018; H01H 2215/022; H01H 2215/026; H01H 2215/034; H01H 2215/036; H01H 2221/036; H01H 2227/022; H01H 13/85; H01H 2209/01; H01H 2215/024; H01H 2215/008; H01H 2215/012
USPC ..... 200/406, 402, 405, 408, 412, 440, 468, 200/513, 516, 275
See application file for complete search history.

(56) References Cited

U.S. PATENT DOCUMENTS 4,195,210 A * 3/1980 Pounds ..... H01H 1/403 200/206
4,463,234 A 7/1984 Bennewitz
(Continued)

FOREIGN PATENT DOCUMENTS

JP 2010146737 A 7/2010

OTHER PUBLICATIONS

Extended European Search Report dated Dec. 4, 2013 issued in EP 13 173 957.5, 8 pages.

*Primary Examiner* — Anthony R. Jimenez
(74) *Attorney, Agent, or Firm* — Conley Rose, P.C.; J. Robert Brown, Jr.; Albert A. Abbou

(57) ABSTRACT

A dome-shaped element disposable in a keyboard of an electronic device is provided. The dome-shaped element includes a concave surface originating at a center and terminating at a periphery. The concave surface includes an annular array of elastic elements extending from the center to the periphery. At least one of the elastic elements includes a first portion with a first slope proximate to the center and a second portion with a second slope proximate to the periphery. The concave surface is deflectable between an un-deflected position and a deflected position and is configured to affect an operation of the electronic device in the deflected position.

26 Claims, 5 Drawing Sheets

(56) References Cited

U.S. PATENT DOCUMENTS

| | | | | |
|---|---|---|---|---|
| 4,508,942 | A * | 4/1985 | Inaba | H01H 13/702 200/306 |
| 4,803,316 | A | 2/1989 | Hayashi et al. | |
| 5,720,472 | A | 2/1998 | Ohgitani | |
| 6,423,918 | B1 * | 7/2002 | King | H01H 13/48 200/406 |
| 6,563,068 | B2 | 5/2003 | Yamagata et al. | |
| 6,603,086 | B2 | 8/2003 | Kawaguchi et al. | |
| 6,700,085 | B2 | 3/2004 | Teruyama et al. | |
| 6,774,330 | B2 | 8/2004 | Blossfeld et al. | |
| 6,911,608 | B2 | 6/2005 | Levy | |
| 6,924,789 | B2 * | 8/2005 | Bick | 345/168 |
| 6,936,777 | B1 | 8/2005 | Kawakubo | |
| 7,064,288 | B2 | 6/2006 | Nam | |
| 7,199,321 | B1 | 4/2007 | Huang | |
| 7,217,893 | B1 | 5/2007 | Huang et al. | |
| 7,301,113 | B2 | 11/2007 | Nishimura et al. | |
| 7,312,790 | B2 * | 12/2007 | Sato et al. | 345/173 |
| 7,557,320 | B1 | 7/2009 | Crooijmans et al. | |
| 7,560,655 | B2 | 7/2009 | Karaki et al. | |
| 7,700,890 | B2 | 4/2010 | Chen | |
| 7,968,808 | B2 | 6/2011 | Yamanaka | |
| 7,977,587 | B2 | 7/2011 | Rajagopal et al. | |
| 8,179,378 | B2 | 5/2012 | Aono | |
| 8,203,094 | B2 | 6/2012 | Mittleman et al. | |
| 8,212,160 | B2 | 7/2012 | Tsao | |
| 8,222,553 | B2 | 7/2012 | Zieder | |
| 8,227,714 | B2 | 7/2012 | Rajagopal et al. | |
| 8,243,442 | B2 | 8/2012 | Hobson et al. | |
| 8,259,071 | B2 | 9/2012 | Griffin | |
| 8,269,124 | B2 | 9/2012 | Jung et al. | |
| 8,278,580 | B2 | 10/2012 | Zieder | |
| 8,378,240 | B2 | 2/2013 | Rajagopal et al. | |
| 8,410,381 | B2 | 4/2013 | Yanai et al. | |
| 8,431,853 | B2 | 4/2013 | Kwak | |
| 2002/0056627 | A1 * | 5/2002 | Rochon | H01H 13/7006 200/302.2 |
| 2008/0073193 | A1 | 3/2008 | Hu et al. | |
| 2009/0065342 | A1 | 3/2009 | Yoon et al. | |
| 2010/0140065 | A1 * | 6/2010 | Lee | 200/17 R |
| 2010/0254124 | A1 * | 10/2010 | Bayat | F21L 4/027 362/206 |

* cited by examiner

DOME-SHAPED ASSEMBLY AND HANDHELD ELECTRONIC DEVICE INCLUDING DOME-SHAPED ASSEMBLY

BACKGROUND

Aspects of the invention are directed to handheld electronic devices and, more particularly, to handheld electronic devices includes dome-shaped assemblies.

Numerous types of handheld electronic devices are presently in use. Exemplary handheld electronic devices include personal data assistants (PDAs), handheld computers, two-way pagers and cellular telephones. Many feature wireless communication capability and/or are stand-alone devices that are functional without communication with other devices.

Handheld electronic devices are generally intended to be portable, with many being small enough to fit within a pocket, a belt holster, a briefcase or a purse. As the form factor of such devices has shrunk for improved portability, so has the size of components such as keyboards or keypads. The keyboards or keypads include keys that act as switches for input entry when actuated. In order to further miniaturization, one general approach has involved the use of an electrical key in the form of a resilient dome-shaped element that is electrically conductive and is disposed on a circuit board.

In simplest form, such a dome assembly is a smooth sector of a hollow sphere. When an actuation force is applied to the apex of the dome assembly, the dome assembly collapses to thereby complete an electrical circuit. The collapsing dome assembly provides a tactile feedback to the user of the handheld electronic device. Such simple sphere segments have been generally effective for their intended purpose but often the tactile feedback is not noticeable.

Thus, the dome assemblies are often provided with elastomeric or compliant layers that provide for an improved tactile feel or increase the tactile feel of the dome assembly. However, the elastomeric or compliant layer necessarily increases a thickness or size of the keyboard or keypad.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
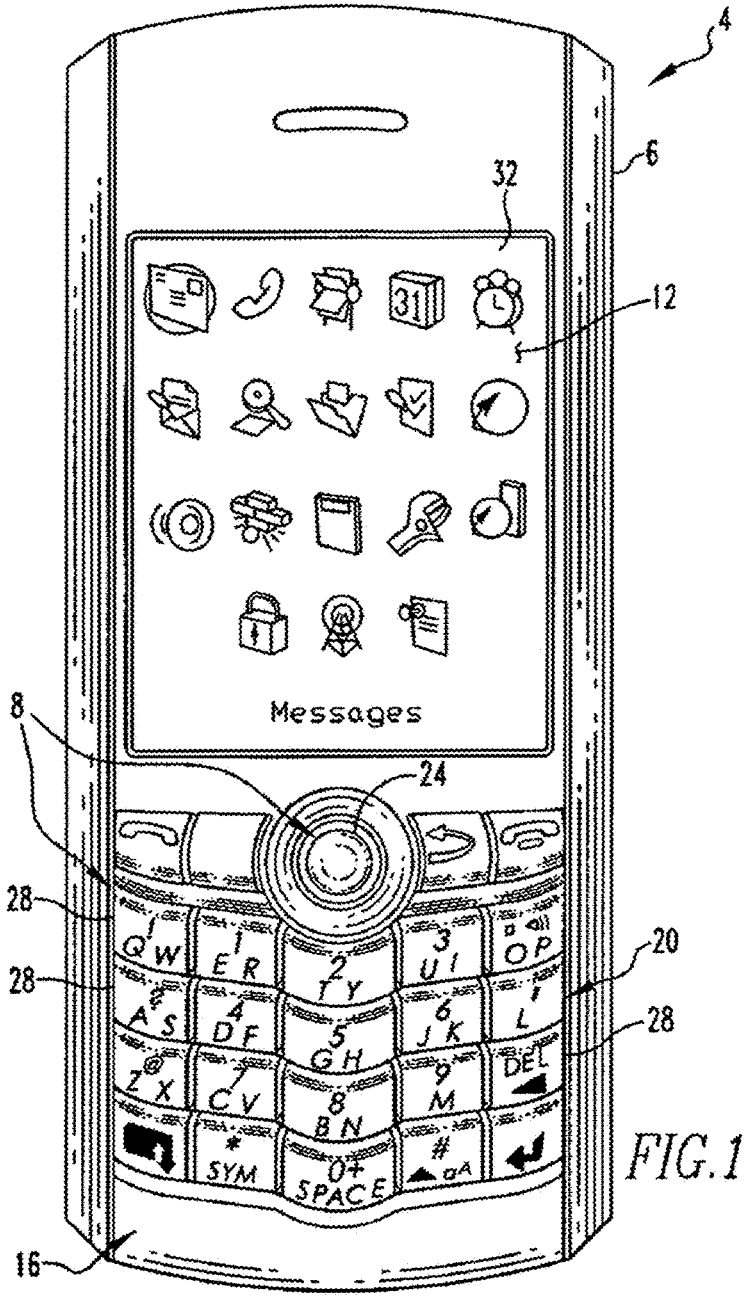
FIG. 1 is a front elevational view of a handheld electronic device in accordance with embodiments.
Figure 2:
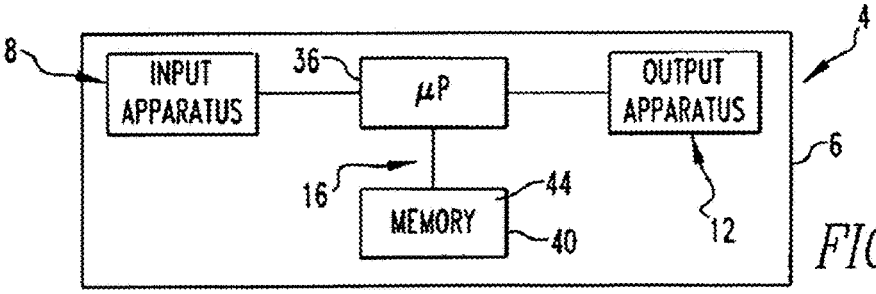
FIG. 2 is a schematic depiction of the electronic device of FIG. 1.

With reference to FIGS. 1 and 2, a handheld electronic device 4 is provided. The electronic device 4 includes a housing 6, an input apparatus 8, an output apparatus 12 and a processor 16 disposed on or in the housing 6. The input apparatus 8 provides input to the processor 16 and the processor 16 provides output signals to the output apparatus 12.

The input apparatus 8 may include a keypad 20 and a navigation input 24. The keypad 20 includes a plurality of keys 28 that are each actuatable to provide input to the processor 16. The navigation input 24 can be an optical pad, a track pad, capacitive input or a track ball to provide navigational and other input to the processor 16. The navigation input 24 may also be translatable to permit selection inputs. The navigation input 24 is able to provide navigational inputs in the vertical direction, i.e., the up-down direction, in the horizontal direction, i.e., the left-right direction, as well as combinations thereof. The keys 28 and the navigation input 24 serve as input members that are actuatable to provide input to the processor 16. The output apparatus 12 may include a display 32, such as a liquid crystal display, LED display, e-ink display, etc.

As shown in FIG. 1, many of the keys 28 have a plurality of letters, i.e., linguistic elements, assigned thereto. For instance, one of the keys 28 represents the letters "A" and "S" while another key 28 represents the letters "Q" and "W". The letters of the example keypad 20 are illustrated as being in an arrangement of a reduced QWERTY keyboard. It is to be appreciated, however, that although the example shown in FIG. 1 utilizes a reduced keypad 20, the keys 28 may be provided as a regular (non-reduced) keypad or other combination of one or more individual keys either integral to an electronic device or part of a separate keyboard assembly external to an electronic device.

Examples of other input members not expressly depicted herein would include, for instance, a mouse or trackwheel for providing navigational inputs. Still other example input members would include a touch-sensitive display, a stylus pen for making menu input selections on a touch-sensitive display displaying menu options and/or soft buttons of a graphical user interface (GUI), hard buttons disposed on the housing 6 of the handheld electronic device 4, and so on. Examples of other output devices would include a touch-sensitive display, an audio speaker, and so on.

The processor 16 includes a processing unit 36 and a memory 40. The processing unit 36 may be, for example, a microprocessor (μP) that interfaces with the memory 40. The memory 40 can be any one or more of a variety of types of internal and/or external storage media, such as RAM, ROM, EPROM(s), EEPROM(s) and FLASH provide a storage register, i.e., a machine readable medium, for data storage. The memory 40 can be volatile memory or nonvolatile memory. The memory 40 has a number of routines 44 that are stored therein and which are executable on the processing unit 36.

Figure 3:
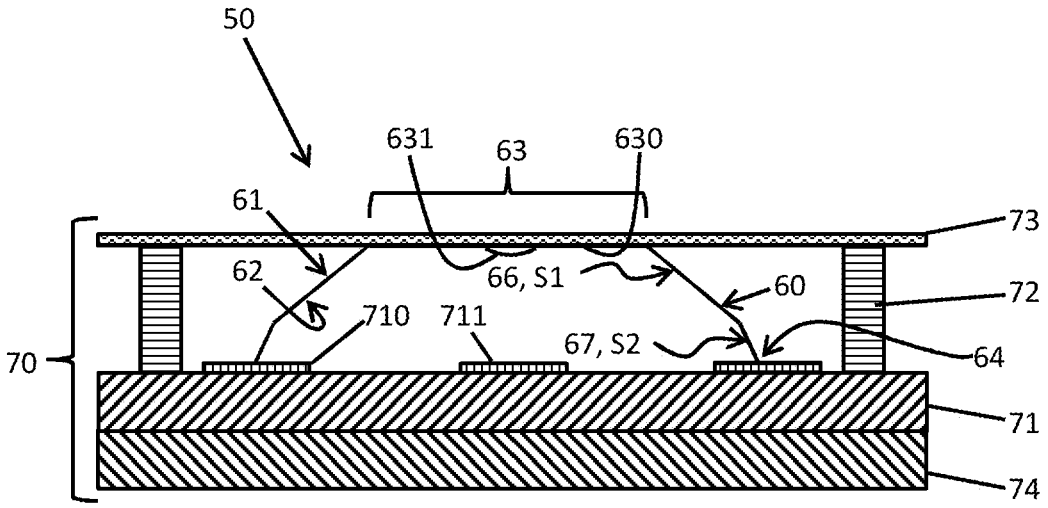
FIG. 3 is a cross-sectional view of a keyboard assembly of the electronic device of FIG. 1.

Underlying at least one of the plurality of keys 28 is a deformable dome assembly 50, which will be described below with reference to FIGS. 3-5 and 6. As shown in FIG. 3, the deformable dome assembly 50 includes a multiple-sloped dome-shaped element 60 (in some cases, a plurality of dome-shaped elements 60) that is (are) disposable in a keyboard assembly 70 of the input apparatus 8 of the electronic device 4 of FIGS. 1 and 2.

The keyboard assembly 70 may be regarded as a component of the dome assembly 50 and includes a substrate 71, spacers 72 and a dome-overlaying laminate 73. The substrate 71 is a generally planar or substantially flat surface on which the dome-shaped element 60 is operably disposed. The substrate 71 may be, but is not required to be, provided as a printed circuit board (PCB) or as a flexible print circuit (FPC). Where an FPC is employed, the keyboard assembly 70 may further include a stiffening layer 74. The spacers 72 are disposed on the substrate 71 to at least partially surround the dome-shaped element 60. The laminate 73 may be include a layer of soft Polyethylene terephthalate (PET) film and is supported on at least the spacers 72 such that the laminate 73 is disposed at a distance from the substrate 71. This distance may be substantially similar to the height of the spacers 72. Adhesive may be provided on either side of the spacers 72 to improve adherence between the spacers 72 and the substrate 71 and between the spacers 72 and the laminate 73.

In accordance with alternative embodiments, height of the spacers 72 may be lower than the height of the dome-shaped element 60. In such cases, once the keyboard assembly 70 is formed, the spacers 72 effectively pull the laminate 73 down toward the substrate 71 and over the dome-shaped element 60.

Figure 4:
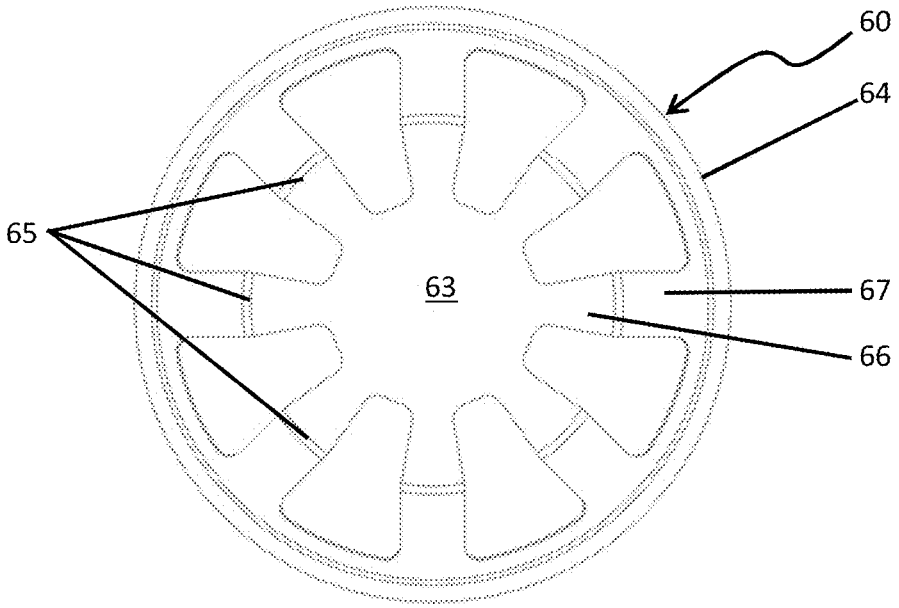
FIG. 4 is a plan view of a dome-shaped element of the keyboard assembly of FIG. 3 in accordance with embodiments.
Figure 5:
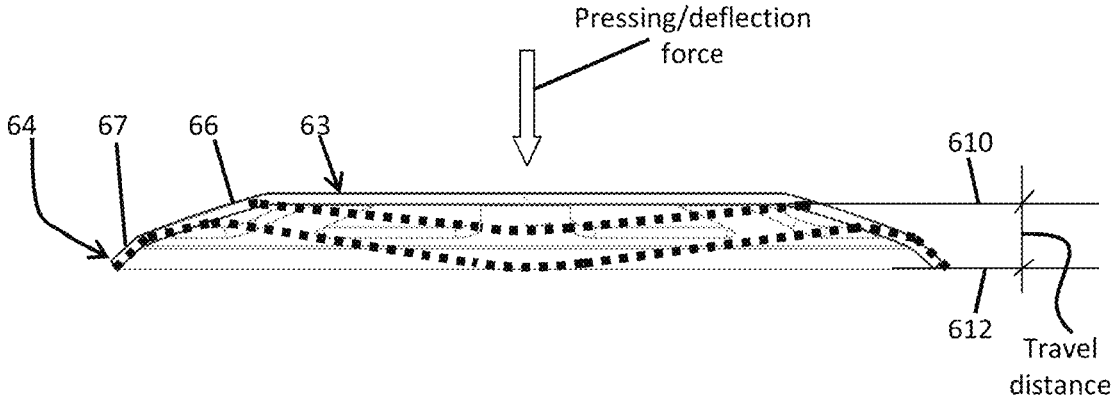
FIG. 5 is a side view of the dome-shaped element in accordance with embodiments.

The dome-shaped element 60 is operably interposed between the substrate 71 and the laminate 73 and includes a convex surface 61 that faces the laminate 73 and a concave surface 62 opposite the convex surface 61. The concave surface 62 originates at a center portion 63 of the dome-shaped element 60 and terminates at a periphery (or peripheral portion) 64 of the dome-shaped element 60. The concave surface 62 includes an annular array of spring-like or elastic elements 65 that extend from the center portion 63 to the periphery 64. As shown in FIGS. 3-5, at least one or more of the elastic elements 65 includes at least a first portion 66 and a second portion 67. The first portion 66 has a first slope S1 and is proximate to the center portion 63. The second portion 67 has a second slope S2 and is proximate to the periphery 64.

In accordance with embodiments, eight elastic elements 65 may be provided in the annular array with each elastic element 65 being similarly shaped and separated from adjacent elastic elements 65 by uniform distances. However, it is to be understood that this is not required and that more or less elastic elements 65 may be provided. In addition, although the annular array of the elastic elements 65 is illustrated as being substantially balanced and uniformly arranged about the center portion 63, it is to be understood that this is not necessary and that the elastic elements 65 need not be balanced or uniformly arranged about the center portion 63.

As shown in FIG. 3, first contact pads 710 and second contact pads 711, which are respectively associated with one or more circuits of the electronic device 4 of FIGS. 1 and 2, may be disposed on the substrate 71. In such cases, the periphery 64 of the dome-shaped element 60 may be disposed in contact with, for example, the first contact pads 710 and the center portion 63 may be disposed at a distance from the second contact pad 711. That is, in accordance with embodiments, the center portion 63 and the concave surface 62 as a whole is centered at the second contact pad 711. The concave surface 62 may be at least partially formed of a conductive material, such as metal or a metallic alloy, and is formed to be deflectable as shown in FIG. 5 between an un-deflected position 610, an intermediately deflected position and a deflected position 612.

Normally, due to the configuration of the elastic elements 65, the concave surface 62 is biased to remain in the un-deflected position 610 (see FIG. 5). However, the concave surface 62 is deflectable, as noted above, from the un-deflected position 610 in response to a pressing force being applied by a user or some other externality to the center portion 63 in a direction leading to the second contact pad 711. This pressing force causes the concave surface 62 to deflect toward and to eventually assume the deflected position 612 (see FIG. 5).

With the concave surface 62 disposed at the deflected position 612, the center portion 63 may be disposed in contact with the second contact pad 711 while the periphery 64 remains in contact with the first contact pads 710. As such, the conductive material of the concave surface 62 may be configured to complete the one or more circuits of the electronic device 4 to thereby affect an operation of the electronic device 4. By a similar token, the one or more circuits of the electronic device 4 may be open with the concave surface 62 remaining disposed at or returning to the un-deflected position (i.e., default) 610 in accordance with the bias provided by the elastic elements 65.

At least a portion 630 of the center portion 63 may be planar or substantially flat such that the portion 630 can abut and lie flush against the laminate 73. In some cases, the portion 630 may be adhered to the laminate 73 as well. The laminate 73 and the portion 630 may also be substantially parallel with the substrate 71. In accordance with such embodiments, the first slope S1 and the second slope S2 may be defined with respect to the slope (or lack thereof) of the center portion 63. In addition, the second slope S2 may be greater than or exceed the first slope S1. It is to be understood, however, that the entirety of the center portion 63 need not be planar or substantially flat and may include various type of surface features. Such surface features may include, for example, depressions 631, micro-half cuts, dimples, etc., in the convex surface 61 that can be used to identify for a user where the center portion 63 is located and to improve the tactile feel of the dome assembly 50 as a whole or to collect dust.

As shown in FIG. 4, at least one or more of the first portions 66 of the concave surface 62 may be tapered toward the center portion 63. By contrast, the second portions 67 may each have a substantially uniform width. This tapering permits the center portion 63 to linearly deform in response to the pressing force being applied thereto. In addition, the concave surface 62 may have a wagon-wheel shape with the center portion 63 acting as a hub, the elastic elements 65 acting as spokes and the periphery 64 acting as the tire. In this case, the elastic elements 65 may all have similar shapes. That is, at least one of the first portions 66 may have substantially similar dimensions as another of the first portions 66 and at least one of the second portions 67 may have substantially similar dimensions as another of the second portions 67.

With the configuration described above, as the pressing force is applied to the center portion 63, the center portion 63 deforms linearly during a ramp-up stage with the linear deformation aided by the tapering of the at least one of the first portions 66. That is, the tapering of the at least one of the first portions 66 provides space in between the elastic elements 65 that permits the center portion 63 to deform into the volume defined by the concave surface 62 in the un-deflected or default position 610. As will be noted below, the ramp-up stage is extended as compared to conventional dome assemblies and thus improves a tactile response of the dome assembly 50. At a conclusion of the ramp-up stage, non-linear deformation in the form of dome-buckling occurs along the first portions 66 and/or at the connections between the first portions 66 and the corresponding second portions 67.

In accordance with embodiments, the periphery 64 may have a diameter of about 4-5 millimeters (mm), a height of the concave surface 62 may be about 0.26-0.36 mm and a thickness of the concave surface 62 may be about 0.035-0.06 mm. The dome-shaped element 60 as a whole provides for a travel distance between the un-deflected position 610 and the deflected position 612 of about 0.22-0.30 mm. Over that travel distance, the dome-shaped element 60 may be configured to provide a non-linear tactile response to a deflection force identified above as the pressing force.

Figure 6:
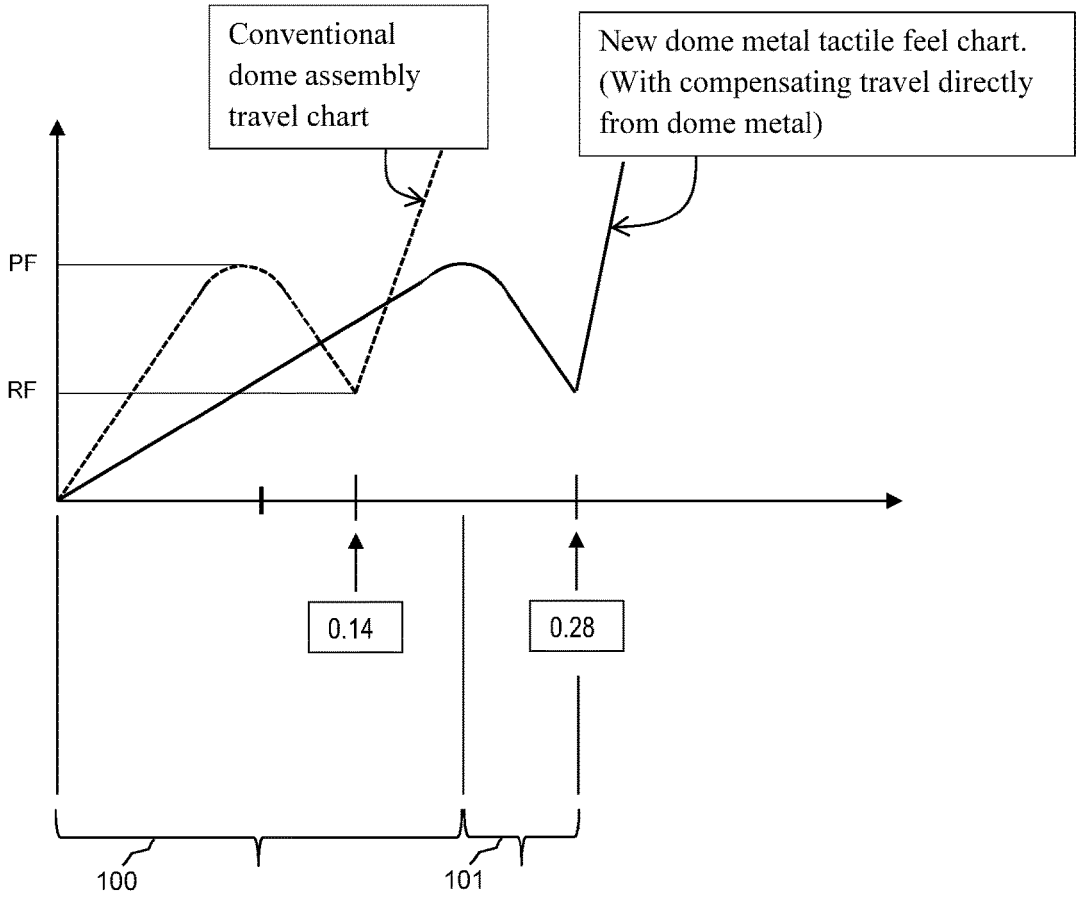
FIG. 6 is a graphical depiction of a tactile response curve associated with the dome-shaped element of FIGS. 4 and 5.

The non-linear tactile response is illustrated in FIG. 6 and includes a first part 100 and a second part 101. The first part 100 includes the ramp-up stage from an initial point of zero pressing force to a peak pressing force (PF) and is associated with a spring or linear deformation of the center portion 63 as aided by the first portions 66. The first part 100 terminates at a deflection of the concave surface 62 of about 0.14-0.28 mm and, more particularly, at a deflection of about 0.22 mm. The second part 101 is then associated with a dome-buckling collapse of the first portion 66 of the at least one of the elastic elements 65. The second stage terminates at a point proximate to 0.28 mm of travel distance at which the center portion 63 contacts the second contact pads 711 and the second portion 67 of the at least one of the elastic elements 65 resists further pressing force (RF).

The dome-shaped element 60 provides for multiple advantages over conventional dome assemblies. The advantages include, but are not limited to, providing a dome-shaped element 60 for a keyboard assembly 70 that provides a non-linear tactile response to a 2 newtons (N) or less pressing/deflection force but does not include an elastomeric or compliant layer between the dome-shaped element 60 and the laminate 73. Thus, the keyboard assembly 70 can be thinned as compared to keyboards with conventional dome assemblies without sacrificing tactile feel. In addition, the relative sizes of the center portion 63, the first portions 66 and the second portions 67 provide for an extended ramp-up stage of the first part 100 of the non-linear tactile response, which, as noted above, terminates at a deflection of the concave surface 62 of about 0.14-0.28 mm. In other words, the dome-shaped element 60 is formed such that the keyboard assembly 70 in thinned but permits increased ramp-up and travel distance as compared to convention dome assemblies in spite of the thinning. The increased ramp-up and travel distance provide for improved tactile feel.

As described above, a dome-shaped element disposable in a keyboard of an electronic device is provided and includes a concave surface originating at a center and terminating at a periphery. The concave surface includes an annular array of elastic elements extending from the center to the periphery. At least one of the elastic elements includes a first portion with a first slope proximate to the center and a second portion with a second slope proximate to the periphery. The concave surface is deflectable between an un-deflected position and a deflected position and is configured to affect an operation of the electronic device in the deflected position.

In addition, a dome assembly for use in an electronic device keyboard is provided and includes a substrate comprising first and second contact pads, a laminate disposed at a distance from the substrate and a dome-shaped element interposed between the laminate and the substrate. The dome-shaped element includes a concave surface originating at a center and terminating at a periphery disposed in contact with the first contact pad. The concave surface includes an annular array of elastic elements extending from the center to the periphery. At least one of the elastic elements includes a first portion with a first slope proximate to the center and a second portion with a second slope proximate to the periphery. The concave surface is deflectable between an un-deflected position and a deflected position and is configured such that the center contacts the second contact pad to thereby affect an operation of the electronic device in the deflected position.

Further, a keyboard assembly for an electronic device is provided and includes a substrate, a laminate disposed at a distance from the substrate and a multiple-sloped dome interposed between the laminate and the substrate. The multiple-sloped dome includes a peripheral portion contacting the substrate and a central portion contacting the laminate and is formed such that the central portion is biased to remain separated from the substrate and to provide a non-linear tactile response to a pressing force applied to the laminate to thereby urge the central portion into contact with the substrate.

Finally, a dome-shaped element is provided for use with a handheld electronic device and includes concave surface as described above but does not include an elastomeric or compliant layer between the concave surface and the laminate. The dome-shaped element is therefore relatively thin but nevertheless provides for an increased ramp-up deflection stage and a non-linear response to a pressing/deflection force.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Techniques, systems, subsystems and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically or otherwise. Other examples of changes, substitutions, and alterations are ascertainable by one skilled in the art and could be made without departing from the spirit and scope disclosed herein.

What is claimed is:

1. A dome-shaped element disposable in a keyboard of an electronic device and comprising:

a concave surface originating at a center and terminating at a periphery;

the concave surface comprising an annular array of elastic elements extending from the center to the periphery, each of the elastic elements comprising a first substantially linear portion with a first slope proximate to the center and a second substantially linear portion with a second slope proximate to the periphery, wherein at least one of the first portions of the elastic elements is tapered toward the center; and the concave surface being deflectable between an un-deflected position and a deflected position and configured to affect an operation of the electronic device in the deflected position, wherein the first slope is the slope of a line parallel to the first portion, and wherein the second slope is the slope of a line parallel to the second portion, and wherein the angle of the first slope relative to a surface of a substrate on which the dome-shaped element is disposed is less than the angle of the second slope relative to the surface of the substrate.

2. The dome-shaped element according to claim 1, wherein the concave surface comprises a conductive material that completes a circuit in the deflected position and forms an open circuit in the un-deflected position.

3. The dome-shaped element according to claim 1, wherein the center includes a portion that is substantially planar.

4. The dome-shaped element according to claim 1, wherein each of the first portions of the elastic elements is tapered toward the center, and wherein the second portions of the elastic elements have a substantially uniform width.

5. The dome-shaped element according to claim 1, wherein at least one of the first portions has substantially similar dimensions as another of the first portions and at least one of the second portions has substantially similar dimensions as another of the second portions, the substantially similar dimensions of the first portions being different than the substantially similar dimensions of the second portions.

6. The dome-shaped element according to claim 1, wherein the periphery has a diameter of about 4-5 mm and a travel distance between the un-deflected and deflected positions is about 0.22-0.30 mm.

7. The dome-shaped element according to claim 1, wherein the electronic device comprises:

a housing;

a processor disposed in the housing;

an input apparatus, including the keyboard, supportively disposed on the housing; and an output apparatus supportively disposed on the housing.

8. The dome-shaped element according to claim 1, wherein the electronic device comprises a handheld device.

9. The dome-shaped element according to claim 1, wherein the keyboard comprises:

the substrate on which the dome-shaped element is operably disposed;

spacers disposed on the substrate to at least partially surround the dome-shaped element; and a laminate supported on at least the spacers such that the laminate is disposed at a distance from the substrate, the distance being substantially similar to a height of the spacers;

the dome-shaped element being interposed between the substrate and the laminate.

10. The dome-shaped element according to claim 1, wherein the dome-shaped element is configured to provide a non-linear tactile response to a deflection force.

11. The dome-shaped element according to claim 10, wherein the non-linear tactile response comprises:

a first part associated with a linear deformation of the center; and a second part associated with a collapse of the first portion of the at least one of the elastic elements.

12. The dome-shaped element according to claim 11, wherein the first part terminates at a deflection of the concave surface of about 0.14-0.28 mm.

13. A dome assembly for use in an electronic device keyboard, the dome assembly comprising:

a substrate comprising first and second contact pads;

a laminate disposed at a distance from the substrate; and a dome-shaped element interposed between the laminate and the substrate and comprising:

a concave surface originating at a center and terminating at a periphery disposed in contact with the first contact pad;

the concave surface comprising an annular array of elastic elements extending from the center to the periphery, each of the elastic elements comprising a first substantially linear portion with a first slope proximate to the center and a second substantially linear portion with a second slope proximate to the periphery, wherein at least one of the first portions is tapered toward the center; and the concave surface being deflectable between an un-deflected position and a deflected position and configured such that the center contacts the second contact pad to thereby affect an operation of the electronic device in the deflected position, wherein the first slope is the slope of a line parallel to the first portion, and wherein the second slope is the slope of a line parallel to the second portion, and wherein the angle of the first slope relative to a surface of a substrate on which the dome-shaped element is disposed is less than the angle of the second slope relative to the surface of the substrate.

14. The dome assembly according to claim 13, wherein a deflection of the concave surface to the deflected position comprises an application of ramped-up force over an extended travel distance at least until the concave surface buckles, wherein the tapering of the at least one of the first portions provides space in between the elastic elements that permits the center to deform linearly during the application of ramped-up force.

15. The dome assembly according to claim 13, wherein the periphery has a diameter of about 4-5 mm and a travel distance between the un-deflected and deflected positions is about 0.22-0.30 mm.

16. The dome assembly according to claim 15, wherein the dome-shaped element is configured to provide a non-linear tactile response over the travel distance.

17. A keyboard assembly for an electronic device, the keyboard assembly comprising:

a substrate;

a laminate disposed at a distance from the substrate; and a multiple-sloped dome interposed between the laminate and the substrate;

the multiple-sloped dome comprising a peripheral portion contacting the substrate and a central portion contacting the laminate and being formed such that the central portion is biased to remain separated from the substrate and to provide a non-linear tactile response to a pressing force applied to the laminate to thereby urge the central portion into contact with the substrate, the multiple-sloped dome further comprising a plurality of elastic elements, each elastic element including a first substantially linear portion disposed at a periphery of the central portion and having a first slope and a second substantially linear portion disposed at a periphery of the first portion and having a second slope, wherein at least one of the first portions is tapered toward the center portion, wherein the first slope is the slope of a line parallel to the first portion, wherein the second slope is the slope of a line parallel to the second portion, and wherein the angle of the first slope relative to a surface of a substrate on which the multiple-sloped dome is disposed is less than the angle of the second slope relative to the surface of the substrate.

18. The keyboard assembly according to claim 17, wherein the electronic device comprises a handheld device.

19. The keyboard assembly according to claim 17, wherein the multiple-sloped dome comprises one of metal and metallic alloy.

20. The keyboard assembly according to claim 17, wherein the plurality of elastic elements comprises multiple-sloped elastic elements, which are sloped relative to the central portion.

21. The keyboard assembly according to claim 17, wherein the multiple-sloped dome has about a 4-5 mm diameter and provides for about 0.22-0.30 mm of travel distance.

22. The keyboard assembly according to claim 17, wherein the multiple-sloped dome has a wagon-wheel shape in a plane defined between the substrate and the laminate, with the central portion of the multiple-sloped dome acting as a hub, the plurality of elastic elements acting as spokes, and the periphery acting as a tire.

23. The keyboard assembly according to claim 17, wherein the multiple-sloped dome is provided as a plurality of multiple-sloped domes interposed between the laminate and the substrate.

24. The keyboard assembly according to claim 23, wherein the substrate comprises first and second contact pads, which are respectively coupled to a circuit of the electronic device, for each of the plurality of the multiple-sloped domes such that:

the peripheral portion of at least one of the multiple-slope domes contacts a corresponding one of the first contact pads; and the central portion of the at least one of the multiple-sloped domes contacts a corresponding one of the second contact pads following the application of the pressing force.

25. The keyboard assembly according to claim 17, wherein the central portion is adhered to the laminate.

26. The keyboard assembly according to claim 25, wherein the central portion lies flush against the laminate.

* * * * *